US005174773A

United States Patent [19]

Jones

[11] Patent Number: 5,174,773

[45] Date of Patent: Dec. 29, 1992

[54] CHILD-PROOF PLUG COVER

[76] Inventor: Steven J. Jones, 17732 Meadow Creek Dr., Eagle River, Ak. 99577

[21] Appl. No.: 820,782

[22] Filed: Jan. 15, 1992

[51] Int. Cl.[5] ..... H01R 13/44

[52] U.S. Cl. ..... 439/147; 439/144; 439/142; 174/67

[58] Field of Search ..... 439/137, 142, 144, 147, 439/892; 174/67

[56] References Cited

U.S. PATENT DOCUMENTS 4,733,017 3/1988 Wolfe-Taylor et al. ..... 174/67
4,895,527 1/1990 Brown et al. ..... 439/147
4,895,999 1/1990 Calderon ..... 174/67
4,970,349 11/1990 Jones ..... 439/142

*Primary Examiner*—Paula A. Bradley
*Attorney, Agent, or Firm*—H. Jay Spiegel

[57] ABSTRACT

A child-proof plug cover includes a covering device designed to overlie an existing double electrical receptacle as commonly found mounted on a wall. The device is sized to allow receipt of two electrical plugs as plugged within the receptacles with their cords extending outwardly from the covering device. The covering device includes two door mechanisms each of which allows insertion of a plug with subsequent closing of a door mechanism to prevent a child from tampering with the device. The covering device may also be sized to preclude a child from pulling an electrical plug out of the wall receptacle.

8 Claims, 2 Drawing Sheets

CHILD-PROOF PLUG COVER

BACKGROUND OF THE INVENTION

The present invention relates to a child-proof plug cover. In the prior art, such devices are generally known, however, no such device is known to Applicant which includes all of the features and aspects of the present invention.

The following prior art is known to Applicant:

U.S. Pat. No. 2,415,602 to Monaco discloses a plug cover designed to fasten over an electrical receptacle to shield plugs plugged therein from tampering. The present invention differs from the teachings of Monaco as including a unique door mechanism designed to allow insertion of a plug therethrough with subsequent locking to prevent tampering.

U.S. Pat. No. 3,601,757 to Gober teaches a device designed to maintain a plug within an electrical receptacle, which device includes a split threaded plug holder which may be placed about the electrical conductor of the plug and subsequently threaded into mounted position to retain the plug in the receptacle.

The present invention differs from the teachings of Gober as teaching the use of a unique door mechanism on a covering device.

U.S. Pat. No. 4,895,527 to Brown et al. discloses a safety cover designed to hold an electrical plug in an electrical receptacle, which device includes an opening through which a plug may be inserted and thereafter rotated to prevent inadvertent or unintentional removal. This is different from the teachings of the present invention which contemplates a unique door mechanism which may be closed about the electrical conductor to preclude tampering with the plug.

SUMMARY OF THE INVENTION

The present invention relates to a child-proof plug cover. The present invention includes the following interrelated objects, aspects and features:

(a) In a first aspect, the inventive device comprises a covering device sized and configured to cover an existing double electrical wall receptacle. The covering device is removably fastened over the existing double receptacle by an elongated screw threaded into the central screw hole of the electrical receptacle which is normally engaged with a screw holding a flat cover thereon. For the purposes of use of the present invention, the flat cover may be removed.

(b) The inventive covering device is sized and configured to enclose two plugs as plugged into their respective receptacles. If desired, the depth of the inventive covering device may be such that the user may not accidentally pull a plug out of its receptacle. In other words, the rear wall of the covering device may be spaced from the wall where the receptacle is mounted a distance such that, with the covering device installed, rear surfaces of the plugs engage the rear surface of the covering device.

(c) Unique door devices are provided on the rear surface of the covering device each of which includes two pivoting doors which pivot inwardly within the covering device from an open position to a position which is closed including a generally circular opening allowing an electrical conductor to extend therethrough.

(d) In the use of the present invention, with the door devices opened inwardly within the covering device, plugs may be inserted through the openings normally closed by the door devices with the door devices subsequently being closed to seal the inner chamber of the covering device. In this configuration, the plugs may be plugged into their respective electrical receptacles and the covering device may be fastened over the electrical receptacles through the use of an elongated screw. In this configuration, the user must unscrew the elongated screw to allow removal of the covering device from around the electrical receptacle so that the plugs may be unplugged.

As such, it is a first object of the present invention to provide a child-proof plug cover.

It is a further object of the present invention to provide such a device including door mechanisms designed to safely enclose plugs within an inner chamber of a covering device.

It is a still further object of the present invention to provide such a device which prevents tampering with dangerous electrical receptacles by children.

It is a still further object of the present invention to provide such a device which may only be removed from an adjacent wall surface through removal of a screw.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
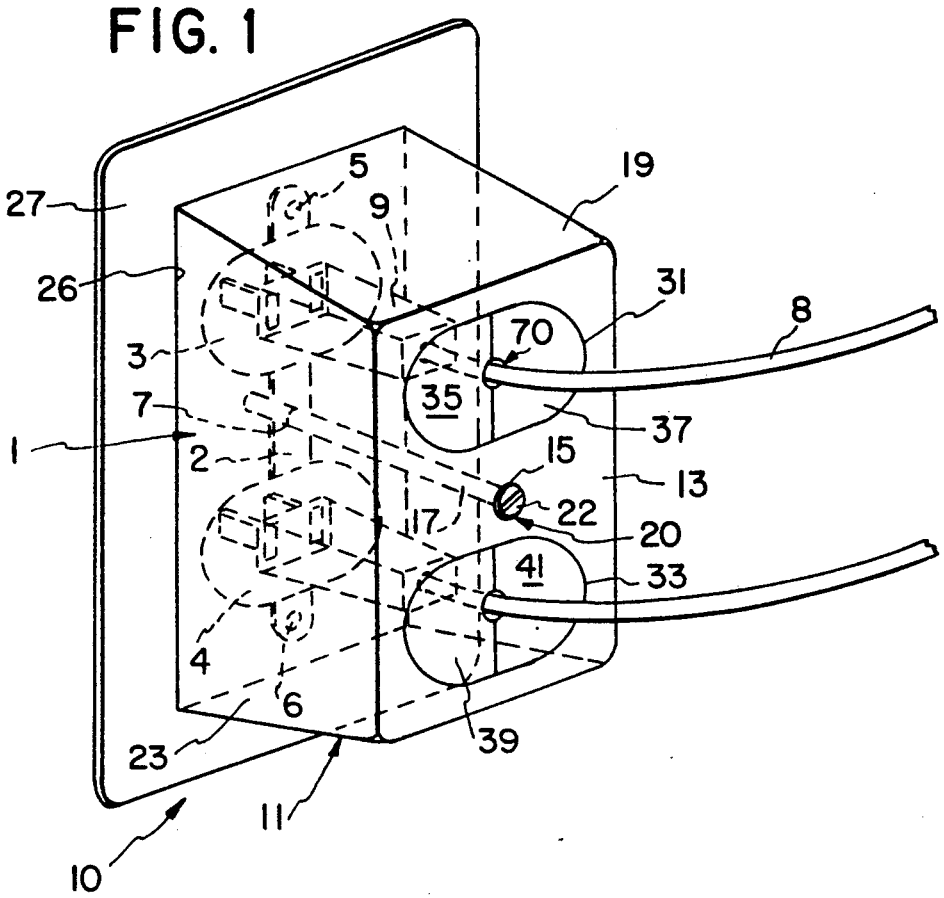
FIG. 1 shows a perspective view of the present invention with certain aspects thereof shown in phantom.

With reference first to FIGS. 1–4, the present invention is generally designated by the reference numeral 10 and is seen to include a covering device 11. As shown in phantom in FIG. 1, an electrical receptacle device 1 includes a mounting bracket 2 which mounts together electrical receptacles 3 and 4. The electrical receptacle device 1 is mounted into the adjacent wall through the use of fasteners extending through holes 5, 6. Furthermore, the bracket 2 has a hole 7 therethrough which normally receives a screw mounting a flat plate over the receptacle 1.

As shown, in particular, in FIG. 1, the covering device 11 includes a rear wall 13 having an opening 15 therethrough through which is extended a screw 17 which is threadably received within the hole 7 of the bracket 2 of the electrical receptacle device 1.

The covering device 11 further includes a top wall 19, a bottom wall 21, and side walls 23, 25. Additionally, the walls 19, 21, 23 and 25 all engage a flat plate 27 which, as best seen in FIG. 1, is designed to completely surround the opening 26 in the wall where the electrical receptacle device 1 is recessed. This flat plate 27 is provided also for aesthetic purposes to provide an attractive border around the main body of the covering device 11.

Figure 3:
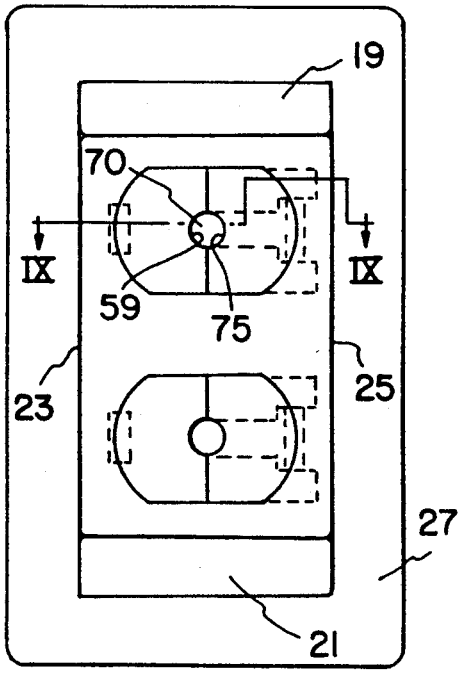
FIG. 3 shows a front view of the present invention.
Figure 2:
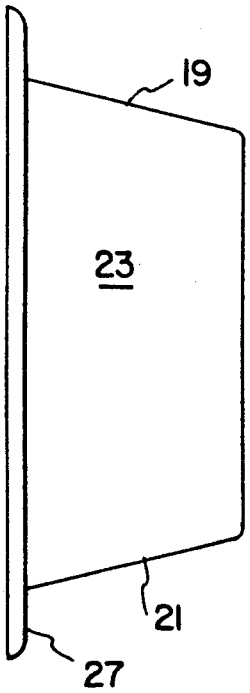
FIG. 2 shows a side view of the present invention.
Figure 4:
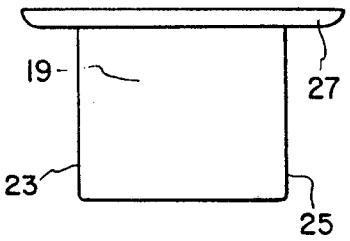
FIG. 4 shows a top view of the present invention.

As shown, in particular, in FIGS. 1 and 3, the rear wall 13 of the inventive covering device 11 has two openings 31, 33 which are generally shaped in the same manner as the outer structure of the receptacles 3, 4, respectively. The opening 31 may be closed by doors 35, 37 while the opening 33 may be closed by the doors 39, 41. These door pairs are identical to one another and, the subsequent details will be of the doors 35, 37, although these details are equally applicable to the doors 39, 41.

Figure 5:
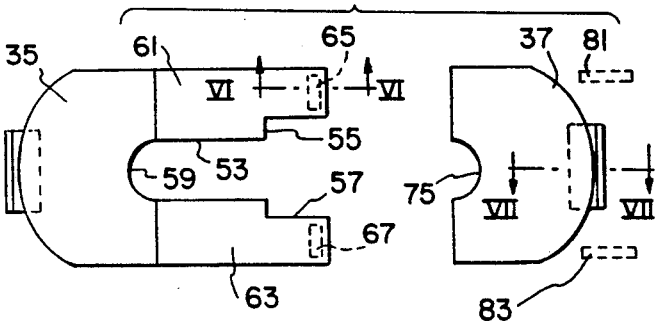
FIG. 5 shows an exploded front view of one of the door mechanisms of the present invention.
Figure 9:
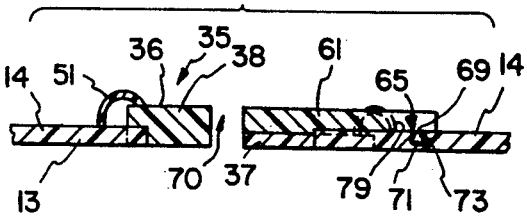
FIG. 9 shows a cross-sectional view along the line IX—IX of FIG. 3.

FIG. 5 shows an exploded view of the doors 35 and 37. As seen in FIGS. 5 and 9, the door 35 is attached to the rear wall 13 of the covering device 11 by a flexible hinge 51 which connects between an inner surface 14 of the rear wall 13 and a forward surface 36 of the door 35 at a thickened area thereof.

As shown in FIG. 5, the door 35 is generally U-shaped in configuration and has a slot 53 which widens at a shoulder 55 to a wider slot 57.

The slot 53 is closed at a curved portion 59 which cooperates with structure on the door 37, as will be described in greater detail hereinafter.

Figure 6:
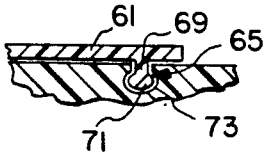
FIG. 6 shows a cross-sectional view along the line VI—VI of FIG. 5.
Figure 7:
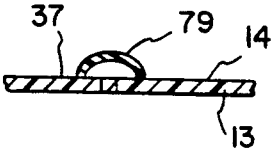
FIG. 7 shows a cross-sectional view along the line VII—VII of FIG. 5.

As shown in FIG. 9, the U-shaped structure of the door 35 includes legs 61, 63 of which the leg 61 is particularly shown in FIG. 9. The legs 61, 63 are thinner than the main body portion 38 of the door 35. As shown in FIGS. 5, 6 and 9, the legs 61, 63 have extending outwardly therefrom in the direction of the rear wall 13 two latches 65, 67. The latch 65 is particularly shown in FIGS. 6 and 9 and includes a stem 69 and an enlarged protuberance 71 which is sized to be insertable and frictionally retained within a partially cylindrical recess 73 formed in the inner surface 14 of the rear wall 13. In this way, the door 35 may be pivoted to the particular position shown in FIG. 9 with the latches 65, 67 inserted within recesses such as the recess 73 to fasten the door 35 in the position shown.

With reference, again, to FIG. 5, the door 37 is seen to include a recess 75 which, as shown in FIGS. 1 and 3, cooperates with the recess 59 to provide a circular opening 70 through which an electrical conductor 8 having a plug 9 attached thereto may extend.

The door 37 is pivotably mounted on the rear wall 13 by a flexible hinge 79 similar to the hinge 51. In a further aspect, the door 37 has latches 81, 83 having structure corresponding to the structure of the latches 65, 67 including recesses (not shown) in the inner surface 14 of the rear wall 13 of the covering device 11.

Figure 8:
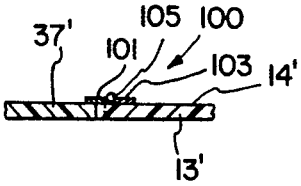
FIG. 8 shows a cross-sectional similar to that of FIG. 7 but showing an alternative hinge embodiment.

With reference to FIG. 8, an alternative construction of the hinge mechanism for the doors 35, 37 is shown, with like elements being referred to using like primed reference numerals.

Thus, with reference to FIG. 8, it is seen that a door 37' is mounted to the inner surface 14' of a rear wall 13' by virtue of a hinge 100 having a first leaf 101 suitably fastened on an edge of the door 37' and with a second leaf 103 suitably fastened to the forward wall 14' of the rear wall 13'. A suitable pin 105 interleaves with cylindrical interleaved portions of the leaves 101, 103 to fasten the leaves 101, 103 in mutually pivotable relation.

With the present invention having been described in terms of its preferred embodiments, the intended operation of the present invention will now be explained.

When it is desired to utilize the inventive device 10 to protect plugs such as the plug 9 from an authorized removal, the device 10 unattached to a wall is configured with the doors 35, 37, 39, 41 opened inwardly within the covering device 11. In such configuration, a plug such as the plug 9 may be inserted through the opening 31. Thereafter, the door 37 is first closed with the latches 81, 83 engaging in the manner explained with reference to FIGS. 6 and 9 in particular concerning the latches 69, 71, 73. Thereafter, the door 35 is closed so that the doors 35, 37 adopt the position shown in FIG. 9 with the opening 70 surrounding the electrical conductor 8 as shown in FIG. 1. A similar procedure is followed concerning the doors 39, 41 and in such configuration, the plugs such as the plug 9 are plugged into their respective receptacles such as the receptacle 3.

In such configuration, the covering device 11 is placed over the electrical receptacle device 1 and the threaded screw 17 is threaded through the opening 7 in the bracket 2 of the electrical receptacle device 1 by suitable means such as a screwdriver engaging the flat 22 of the head 20 thereof. Of course, if desired, the flat 22 may be replaced with any tool engaging recess including a special tool engaging recess sized and configured to receive only a special tool to prevent unauthorized tampering.

With the device so mounted as shown in FIG. 1, the only way in which a child may remove the plugs such as the plug 9 from their respective receptacles such as the receptacle 3, will be to remove the screw 17 and the covering device 11 from the wall. The frictional retention of the latches 65, 67, 81 and 83 is designed to be sufficiently strong enough that a child may not push the doors 35, 37, 39, 41 inwardly against the latching force of the latches.

As such, an invention has been disclosed in terms of a preferred embodiment thereof, which fulfills each and every one of the objects of the invention as set forth hereinabove and provides a new and useful child-proof plug cover of great novelty and utility.

Of course, various changes, modifications and alterations in the present invention may be contemplated by those skilled in the art without departing from the intended spirit and scope thereof.

As such, the present invention is only intended to be limited by the terms of the appended claims.

I claim:

1. In an electrical receptacle device mounted in a building wall having at least one electrical receptacle designed to receive an electrical plug electrically connected on an end of an electrical conductor, the improvement comprising a child-proof cover comprising:

a) an enclosure having an internal chamber;

b) said enclosure having a wall with an opening therethrough;

c) said wall having a pair of doors on an inner surface thereof which may open within said chamber;

d) said doors being cooperable to close over said opening with said conductor extending through a hole formed by at least one of said doors, said hole being small enough to prevent said plug from passing therethrough;

e) said doors having latch means for latching said doors in a closed position thereof; and f) mounting means for releasably mounting said cover over said electrical receptacle device with said plug connected in said receptacle and said doors closed to preclude tampering with said plug and electrical receptacle device.

2. The invention of claim 1, wherein said hole is formed by cooperating portions of said doors.

3. The invention of claim 1, wherein each latch means includes a tongue and groove connection.

4. The invention of claim 1, wherein said enclosure wall comprises a rear wall.

5. The invention of claim 1, wherein said mounting means comprises an elongated screw.

6. The invention of claim 1, wherein each of said doors is pivotably mounted adjacent said opening.

7. The invention of claim 6, wherein each of said doors is pivotably mounted with a flexible hinge.

8. The invention of claim 6, wherein each of said doors is pivotably mounted with leaves and a pin pivotably connecting said leaves.

* * * * *